US005779331A

United States Patent [19]

Fox et al.

[11] Patent Number: 5,779,331

[45] Date of Patent: Jul. 14, 1998

[54] FILE MANAGEMENT SYSTEM

[76] Inventors: Keith Thomas Fox, 2407 Lennox St., Easton, Pa. 18042; Robert Edward Ball, 45 Strawbridge Ave., Westmont, N.J. 08108

[21] Appl. No.: 696,725

[22] Filed: Aug. 14, 1996

Related U.S. Application Data

[60] Provisional application No. 60/002,564 Aug. 21, 1995.

[51] Int. Cl.[6] ..... A47B 63/00

[52] U.S. Cl. ..... 312/184; 312/183; 211/55; D6/467

[58] Field of Search ..... 312/183, 184; 211/45, 46, 55, 128.1; D6/188, 467, 468, 509, 510; D19/78, 90

[56] References Cited

U.S. PATENT DOCUMENTS

| | | | |
|---|---|---|---|
| D. 249,273 | 9/1978 | Day | D19/78 |
| D. 288,939 | 3/1987 | Boon | D19/78 |
| D. 321,608 | 11/1991 | Hay | D6/467 X |
| D. 326,378 | 5/1992 | Yunger et al. | D6/467 |
| 401,389 | 4/1889 | Stoddard . | |
| 1,706,307 | 3/1929 | McCarthy | 211/55 |
| 1,785,815 | 12/1930 | Kurtz, Jr. . | |
| 2,278,403 | 3/1942 | Jonas . | |
| 2,291,675 | 8/1942 | Arelt . | |
| 2,291,724 | 8/1942 | Jonas . | |
| 2,623,527 | 12/1952 | Guichard . | |
| 2,665,808 | 1/1954 | McAlister | 312/183 X |
| 3,365,259 | 1/1968 | Heisman et al. | 312/184 X |
| 3,396,731 | 8/1968 | Peebles . | |
| 3,428,186 | 2/1969 | Michel | 211/55 |
| 3,788,718 | 1/1974 | Bjorn et al. | 312/184 |
| 4,077,520 | 3/1978 | Stevenson | 312/183 X |
| 4,974,733 | 12/1990 | Evans | 211/11 |
| 5,184,737 | 2/1993 | Hardy | 211/55 |
| 5,209,386 | 5/1993 | Allison | 224/275 |
| 5,477,967 | 12/1995 | Voorhees et al. | 211/55 |
| 5,575,396 | 11/1996 | Smed | 211/55 X |

FOREIGN PATENT DOCUMENTS

| | | | |
|---|---|---|---|
| 752881 | 10/1933 | France | 312/184 |
| 1384026 | 11/1964 | France | 312/184 |
| 186568 | 9/1936 | Switzerland | 312/183 |
| 518234 | 2/1940 | United Kingdom | 312/184 |

OTHER PUBLICATIONS

Tapper Business Supplies Catalog, pp. 155, 158–161, 163, 173, 178, 197, and 226, Dec. 1995.

"Active File" manufactured by Neat Ideas® Division of Fellows Manufacturing Co., Itasca, IL, no date given.

*Primary Examiner*—Peter M. Cuomo
*Assistant Examiner*—James O. Hansen

[57] ABSTRACT

A vertical filing assembly in which a number of hanging, expandable compartments may be slidably suspended behind and above one another in a step-like manner. The compartments are configured so that the top edge of the back panel of each compartment is higher than the top edge of its front panel which, in turn, is at least as high as the back panel of the compartment in front of it.

10 Claims, 3 Drawing Sheets

FILE MANAGEMENT SYSTEM

This application claims the benefit of Provisional application Ser. No. 60/002,564, filed Aug. 21, 1995.

1. Field of Invention

This invention relates to a vertical filing assembly, particularly one adapted for desktop use, having a number of expandable compartments stepped vertically and configured so that the top edge of the back panel of each compartment is higher than the top edge of its front panel. The top edge of the front panel of each compartment preferably is low enough so that the compartment's contents, such as stationery or manila folders, are partially visible. The invention also relates to a vertical filing support and hanging folders adapted for use with the assembly.

2. Background Discussion & Related Art

Keeping information well organized and accessible within the work space is crucial for achieving business goals. Effectively organizing information requires managing paperwork, which in turn, requires managing the file folders in which these papers are kept.

There are many widely known systems for organizing information which keep paper within file folders. It might even be argued that these systems have reached maturity since the last major development in this field was the Pendaflex® hanging file folder invented over fifty years ago. These folders and a system for their hanging are taught in U.S. Pat. No. 2,291,724, which is incorporated herein by reference.

A Pendaflex® folder generally has a front panel and a back panel of equal size joined together at their bottom edges to form a pocket for the storage of papers. This pocket is typically V-shaped but may be U-shaped (known as a "box-bottom" file) to hold larger amounts of material. These types of folders are suspended from their top corners by hooks that project from each of the terminal ends of metal bars that extend across the top edge of each panel. The hooks allow the folder to swing freely from a mounting means such as the top edges of two horizontal bars set parallel to each other (as in the common metal insert for a file cabinet drawer taught in U.S. Pat. No. 2,278,403). They may also be suspended in a small plastic box that can reside on a desktop, that being a smaller version of the container shown in FIG. 1 of U.S. Pat. No. 2,291,724.

The wide spread adoption of the Pendaflex® filing system is due largely to the benefits realized when storing papers in a filing cabinet. The tendency that manila folders have to slide down underneath one another when placed upright in a drawer is completely eliminated by using Pendaflex folders® which, being suspended from the top, cannot slide down. In addition, this system provides for a functional compression throw, which is the distance a hanging folder can be opened while still suspended in a drawer, pushing or compressing the adjacent folders out of the way. If the drawer is not overstuffed, a folder can be opened wide enough for an entire hand to fit down inside, making it easy to place or retrieve papers without removing the entire folder from the drawer. Unfortunately many people have stopped using manila folders altogether, storing papers directly inside the Pendaflex® hanging folder which is then removed from the filing cabinet and carried to the desk when its contents are needed.

Pendaflex® folders, however, are not friendly in a desktop environment. Their hooks stick out and snag on paperwork, books, clothing (they love sweaters) and everything else nearby. The thick heavy metal bars make them cumbersome to carry and allow these folders to flop open easily, spilling out their contents. The plastic label inserts break easily, needing repeated replacement, and often catch on other objects and fly across the room. These and various other problems have led the wise to avoid storing papers directly in a Pendaflex® folder. Instead, papers are best kept within a manila folder with the hanging folder used only as a "jacket" for standing the manila folder upright inside a filing cabinet drawer. This jacket then remains in the filing cabinet while the manila folder is used to carry papers to the desk.

Until the present invention, however, there were no truly effective devices for managing manila file folders at the desktop. Though many varied and diverse systems have been used, none work well. The three most common of these systems are Trays, Vertical Stands, and more recently, small Pendaflex® Desktop File Boxes.

Trays similar to that shown in FIG. 1 of U.S. Pat. No. 4,074,810, provide nothing more than virtual desktop surface. This is adequate for keeping blank paper stock and the like, but there is no functional difference between putting file folders in a tray or merely laying them in piles on a desk, except that since trays keep these piles from falling over, the stack of folders can become infinitely high as more trays are added, allowing more files to be lost in the stack. In addition, placing folders in a tray tends to re-prioritize projects in an ad-hoc manner with the folder on top usually receiving the most attention whether deserved or not.

Vertical stands like that depicted in FIG. 1 of U.S. Pat. No. 4,974,733, seem to offer better management of manila folders than do trays. The simplest type of stand consists of a flat base having several rigid, spaced apart dividers rising from the base to form compartments in which manila folders can be kept standing upright on the desk within easy reach. Some units elevate the base of each compartment one behind the other in a step-like manner to provide for a better view of the manila folder labels.

Other units, like the "Special Edition Active File" marketed by Neat Ideas, a Division of Fellowes Manufacturing Co., enclose their compartments within a box-like shell, apparently to guard against the tendency that manila folders have of falling out the sides of the stand. This shell also acts as a guide to line up the folders so that their labels are not obscured by other folders out of position.

In either case, whether the sides of a stand are open or closed, the fixed space between the rigid dividers tends to be either too large to maintain a suitable structural support to stand folders upright, or too small, relative to the nominal thickness of manila folder filled with papers, to provide an adequate compression throw. When a vertical stand is empty, it is easy to place and retrieve a single folder, but this becomes more difficult and unwieldy as the stand becomes populated, until a significant effort is needed to stuff the folders down inside, as the compression throw of each compartment diminishes with the addition of each folder.

This problem is further compounded in many designs by the fact that the dividers which separate these compartments are usually shorter and narrower than the manila folders they hold. This makes it impossible to clearly distinguish one compartment from another as the dividers become obscured by the folders when placed in the stand. Any useful device for managing manila folders should provide a reliable "frame of reference" which instantly shows where a folder may be placed.

Pendaflex® Desktop File Boxes partially overcome this lack of a reliable frame of reference. When hanging folders are used as jackets to hold manila file folders, each Pendaflex® folder becomes, in essence, a flexible vertical compartment whereby the top edges of the jacket provide a frame of reference, albeit a very small frame of reference, that shows where a manila folder may be placed. Unfortunately, while the Desktop Box may promise to provide the same improved efficiency for the desktop as that realized by using Pendaflex® a jackets in a filing cabinet, there are no fewer than six flaws with this system.

First, nearly the entire manila folder slides completely down inside the jacket. While this helps retain a frame of reference since the manila folder does not visually obscure the top edges of the hanging folder, time is wasted either by writing a second label for the Pendaflex® jacket, or by repeatedly searching for the right folder since the manila folder label cannot be read. Second, a manila folder may be lost down inside the box if it is inadvertently placed in between the jackets. Third, reaching down inside a jacket to retrieve a folder will almost always cause an impact to the cuticles, which, however slight, is still very annoying. Fourth, even if the time wasted by double labeling was somehow acceptable (for example the whole jacket might be moved into a filing cabinet later), these Pendaflex® labels are positioned at near eye level since the box usually sits on top of the desk. As the box fills with folders, their labels visually obscure one another, especially since the visual field for these labels is compressed due to the single level of storage which extends horizontally parallel to the desk surface instead of perpendicular to the line of sight. This particular problem becomes worse as the box becomes over-populated because of the simple shell-like design which dumps all the folders into one aggregate, a fifth flaw, severely reducing the compression throw until the box becomes unusable. Finally, the use of a box carries the temptation to abandon manila folders again in favor of Pendaflex® folders, reviving all those problems previously discussed.

It is an object of the present invention to provide a vertical file assembly of compartments which presents a functional frame of reference that visually demarcates one compartment from another, instantaneously showing where contents may be placed.

It is another object of the present invention to allow for instant visual recognition of these contents.

One principal object is to provide compartments which are flexibly openable at top which will allow for greater ease of use by virtue of both dynamic adjustment and functional compression throw.

A further object is to eliminate the possibility of misplacing contents in an area between compartments.

Yet another object is to provide an assembly of compartments for the desktop in which Pendaflex® Technology is used to stand contents such as manila folders upright and accessible on the desk.

These and other objects and advantages of the present invention, which consists of the novel construction, combination and arrangements of parts, will become apparent when more fully described, illustrated and claimed hereinafter.

SUMMARY OF THE INVENTION

This invention generally relates to office equipment which keeps file contents such as manila folders and paperwork organized upright on a desktop or other surface for improved accessibility. More particularly, the present invention relates to filing devices which provide a desktop filing support with suspended compartments designed for ready access to their contents.

A filing assembly is comprised of a support which holds a series of vertical compartments for the storage of paperwork, manila folders, or other types of contents, each compartment having a front panel and a back panel joined along their bottom edges, preferably with an essentially flat, substantially rigid floor member to form a U-shaped pocket similar to a Pendaflex® box-bottom file folder. Preferably, when in place, the front panel of each compartment has a shorter vertical height than that of the back panel of that compartment.

The compartments are configured to clearly show the location into which their contents are to be placed. Specifically in the present invention, the top edge of the back panel for each compartment extends above the top edge of its front panel, forming a conspicuous frame of reference that easily and quickly identifies the top opening of that compartment. To preserve this frame of reference, a compartment is preferably sized so that the top edge of the back panel remains visible above the contents of a filled compartment.

In a specific embodiment for containing manila folders, however, it is preferable that the top edge of the back panel be positioned slightly below the top edge of the manila folder label tab, but higher than the top edge of the folder itself This allows the manila folder tab to be easily pushed forward away from the back panel by the lower corner of another manila folder being placed into the compartment. The frame of reference is preserved since a portion of the back panel becomes visible when a manila folder is removed.

In addition, the top edge of the front panel of a compartment preferably is lowered such that the contents stored within are partially revealed to allow for their instant recognition. For example, in an embodiment for the organization of manila folders, this top edge of the front panel would be positioned below the label of the manila folder. In an embodiment for office stationery, this top edge of the front panel would be positioned below the letterhead. Furthermore, these compartments are stepped behind and above one another, configured in such a manner that any contents as revealed by the lowered top edges of the front panels remain visible.

Each compartment is flexibly openable at the top, being slidably suspended in such a manner that permits both the front and back panels to hang freely from their upper corners and move back and forth independently from one another. Preferably, Pendaflex® technology, which employs a hook projecting from each of the terminal ends of a metal bar extending transversely across the top edge of a panel is used to form the suspension means of the compartments. These hooks slidably engage the desktop filing support of this invention to form the filing assembly.

The desktop filing support has a set of mounting means provided for each panel, the means being two tracks spaced horizontally apart and substantially parallel to each other. Each track is preferably formed by the lower edge of long, thin slot extending along each side wall of a U-shaped assembly which provides the support for these compartments when sitting on a desk or other surface.

The sets of mounting means for the back and front panels are preferably stepped, being vertically spaced apart from one another to easily form both the needed frame of reference and the sufficiently lowered front edge of each compartment for content visibility.

It is also preferable that these stepped means overlap, extending horizontally above one another to allow for a sufficient length of travel for the panels to move apart. This yields a functional compression throw, permitting each compartment to open freely enough to easily place or retrieve contents with one hand.

Of particular importance in the present invention is that a plurality of overlapping sets of mounting means are provided with each set spaced vertically from and substantially parallel to the other sets. For certain types of contents, it may be preferable that the tracks themselves slope down from back to front, using gravity to position the compartments all the way forward.

Each compartment may be formed individually and suspended from the mounting means. These independent hanging compartments preferably take the form of a modified Pendaflex® folder comprising a front panel shorter in height (top edge to bottom edge) than the back panel. The difference in height should be about equal to the vertical spacing of the mounting means in the filing support which is determined by the desired level of exposure of the contents.

Subsequent compartments may be joined together to form an insert which eliminates the possibility of contents being lost between compartments. The insert so formed may be integral to the assembly or may be provided separately for later insertion. With individual compartments, however, more flexibility can be achieved. For example, standard Pendaflex® folder may be interspersed with the modified hanging folders of the present invention.

With the foregoing compartments installed in the filing support, it will be seen that there is no one single position along the mounting means that a compartment must occupy, but the nominal position of the compartments will dynamically adjust relative to each other as forces are exerted on the system, such as by the weight of a folder dropped into a compartment, or by a hand sliding the panels apart to retrieve a folder. This dynamic adjustment of vertically stepped compartments is a major functionality of the present invention.

DETAILED DESCRIPTION OF THE INVENTION

Figure 1:
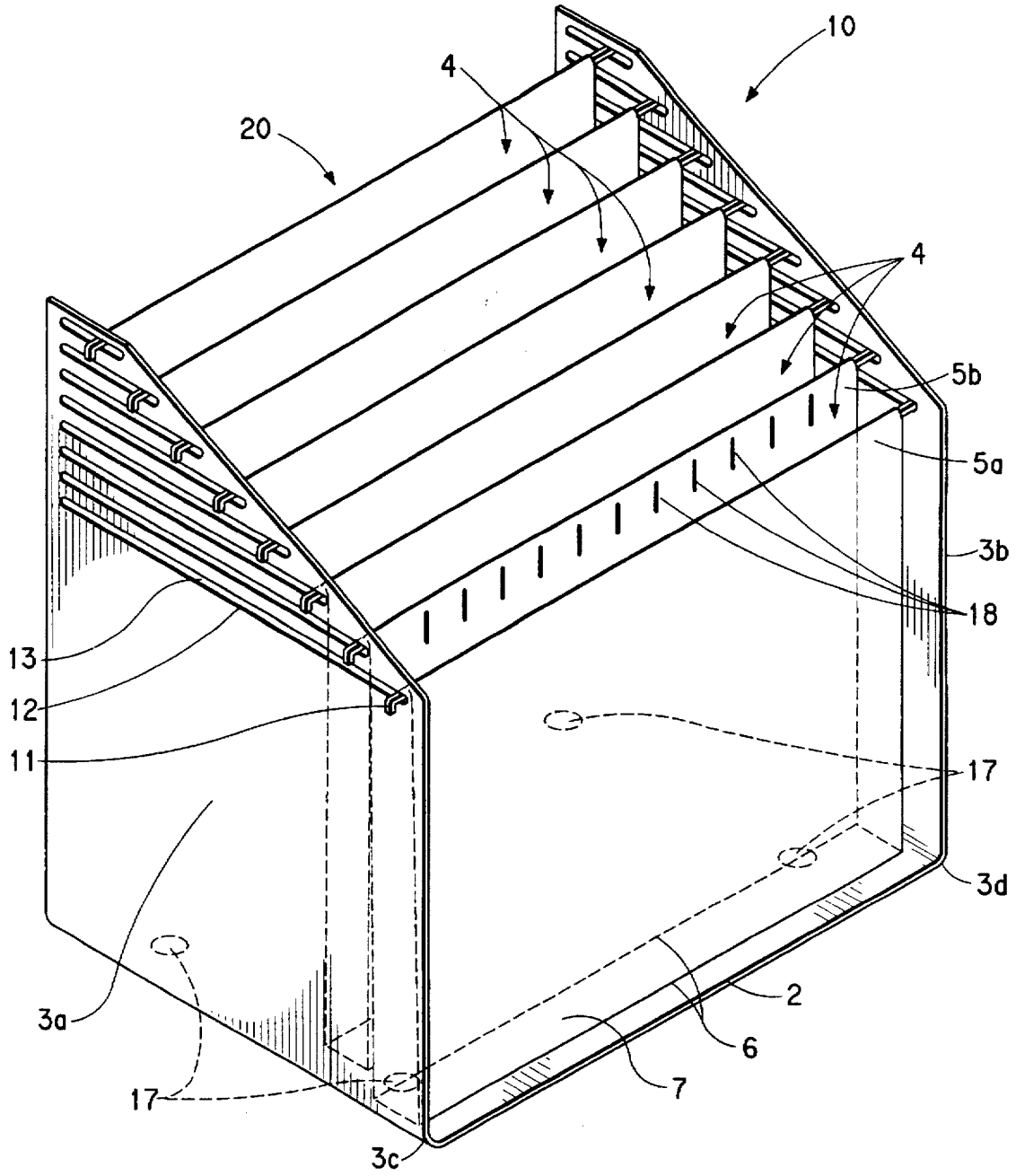
FIG. 1 is a perspective view of the file assembly of the present invention with a partial phantom of two compartments.

FIG. 1, by way of illustration and not limitation, depicts a vertical file assembly or system made up of a filing support 10 and an insert 20 positioned within. The insert 20 comprises a series of compartments 4 joined together (referred to herein as "bone-piece insert"). The insert 20 may also be made up of individual compartments that are not joined together. The assembly is particularly adapted for desktop use.

The filing support 10 may be made of plastic, wood, paper, metal, or any other suitable material or combination thereof provided that the material has sufficient structural soundness to support the insert 20 and its contents. The filing support 10, as shown in FIG. 1, includes a base 2 and rigid side walls 3*a* and 3*b*. The side walls 3*a* and 3*b* extend vertically upward from the base 2, are positioned parallel to each other, and are spaced from each other sufficiently to allow containment and support of insert 20 or, alternatively, individual compartments as hereinafter described. The base 2 is shown as a continuation of the side panels 3*a* and 3*b* formed by bending (plastic for example) at right angles at the lower edges 3*c* and 3*d* of the side walls, but the base may be joined by other means (adhesives, fasteners, and other structural alternatives known in the art) along the two edges 3*c* and 3*d* so as to provide separation and support of the two rigid, upwardly extending, support side walls 3*a* and 3*b*.

Also, a filing support, not having a base as such, is within the scope of the present invention. In a configuration not having a base as such, the bottom edges 3*c* and 3*d* of side walls 3*a* and 3*b* would form the contact between the filing support and the desktop. The side walls 3*a* and 3*b* may then be joined by any means that provides for their intended relationship. For example, the filing support could be made with a back (not shown) extending between the back edges of side walls 3*a* and 3*b*. The back can be joined to the side walls in the same manner indicated above for the base 2. That is, the back can be a continuation of the side walls 3*a* and 3*b* formed by bending (plastic for example) at right angles at the back edges of side walls, but the back may be joined by other means. Alternatively, the side walls 3*a* and 3*b* could be affixed directly to an office partition or other device which would serve the function of the back. Still another option would use rods positioned between the side walls, say at the corners, one end of each rod fastened to side wall 3*a* and the other end of each rod fastened to side wall 3*b*. The rods should be both long enough to provide the desired separation of side wall 3*a* from side wall 3*b* and of substantially equal length so that when assembled, side wall 3*a* is essentially parallel to side wall 3*b*.

The function of the side walls 3*a* and 3*b* is to provide a structure of sufficient integrity to maintain a mounting means of proper horizontal and vertical spacing and relation which will support the weight of the compartments 4 and their contents. As such, the side walls may be replaced with any means that provides the same function.

Figure 3:
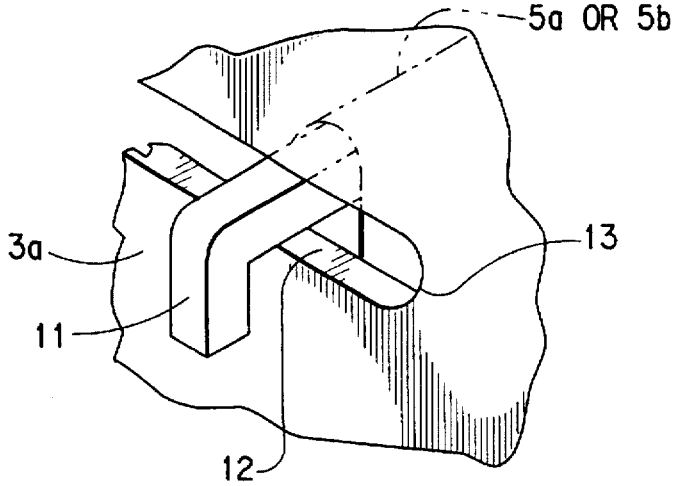
FIG. 3 is a detail of a preferred mounting and suspension means shown in FIG. 1.
Figure 4A:
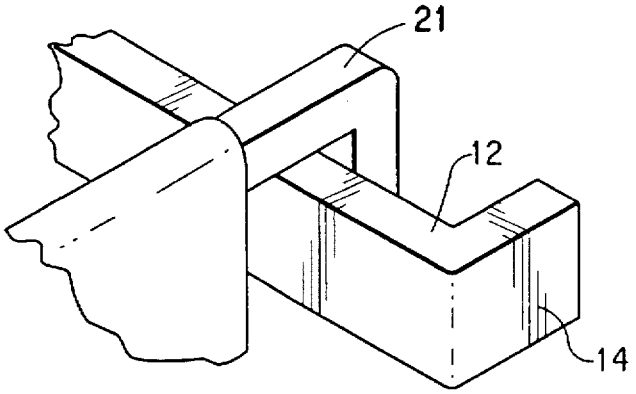
FIGS. 4*a*, 4*b* and 5 depict mounting and/or suspension means that differ from that illustrated in FIG. 1 and detailed in FIG. 3.
Figure 4B:
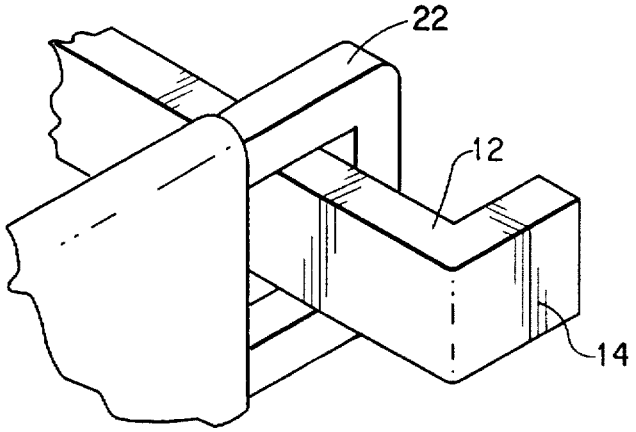
Figure 5:
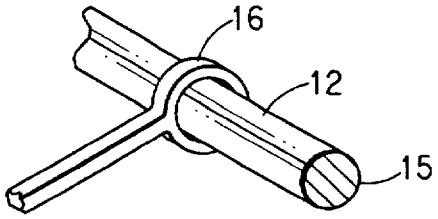

The side walls 3*a* and 3*b* in FIG. 1 are shown with a series of substantially horizontal slots 13 oppositely disposed in each side wall, the lower flat edges of the slots form tracks 12 (mounting means) from which insert 20 having a suspension means can be slidably suspended. The suspension means may be in the form of projections 11 that extend outwardly and laterally from compartments 4, such projections being substantially the same as the hooks found on a standard Pendaflex® folder (see FIG. 3, hook 11, and FIG. 4*a*, hook 21). They may also take other forms such as eye member 16 (see FIG. 5) and loop 22 (see FIG. 4*b*). As will be appreciated, various other mounting means for suspending compartments can be configured. For example, FIGS. 4*a* and 4*b* show a track 12 formed by the upper edge of a bar 14, while FIG. 5 shows a track 12 formed by the top surface of rod 15.

Tracks 12 need not be flat. The surface of a track 12 may be beaded or rounded to reduce friction and allow for an easier sliding of the suspension means of the compartments. It is not necessary that tracks 12 be perfectly horizontal. Tracks 12 may be slanted downwardly from back to front allowing gravity to dynamically adjust the compartments 4 to a preferred opening size and position.

It is preferred that the mounting means such as the tracks in FIG. 1 overlap, extending horizontally one above the other to provide sufficient compression throw, that being the distance any compartment 4 can be opened at the top, for better and easier access to its contents.

Insert 20 comprises a series of vertically and horizontally spaced compartments 4. The insert 20 is shown in FIG. 1 as a one-piece insert with compartments 4 joined together. The insert 20 may also be made up of individual compartments that are not joined together.

Insert 20 is shown in FIG. 1 as movably suspended between the side walls 3*a* and 3*b*, each compartment 4 having both a front panel 5*a* and a back panel 5*b* flexibly attached along their lower transverse edges 6, preferably to an essentially flat, substantially rigid floor member 7. The floor member 7 can be V- or U-shaped as in standard or box-bottom Pendaflex® folders. Contents are placed into a compartment 4 through the opening defined between the top edges of panels 5*a* and 5*b*, each compartment 4 being configured in such a manner that the top edge of the back panel 5*b* of a compartment 4 extends above the top edge of the front panel 5*a* to form a conspicuous frame of reference for this opening. Preferably, each floor member 7 of a compartment 4 is set deep enough so that the top edge of each back panel 5*b* remains visible when the compartment is not completely filled, maintaining the frame of reference for placement of contents. The top edge of each front panel 5*a* or a portion thereof is preferably lowered enough to provide for visual recognition of the contents when placed within, but not so low as to allow these contents to fall out. In a preferred embodiment, the panels 5*a* and 5*b* of a compartment 4 are suspended from their top corners with the means used for mounting a front panel 5*a* different from and positioned lower than the means used for mounting the corresponding back panel 5*b*, hence offsetting the top edges to both form the desired frame of reference and provide for the desired content visibility at the same time. While there are no explicit side panels in a compartment 4 the side walls 3*a* and 3*b* may act as virtual side panels by proximity, helping both to align any contents, such as paperwork or manila folders, and to keep any contents from falling out the sides.

The overall sizing (height, width and depth) of a compartment 4 can be configured to accommodate any type of contents expected to be placed within. Width typically will be letter-sized or legal-sized as in standard Pendaflex® folders, but can be of any desired width. For example, it may be specifically sized to hold specialty card stock, catalogs, sheet music, or the like.

The filing assembly of the present invention provides a plurality of compartments 4 in the filing support with each subsequent compartment 4 placed horizontally one behind the other and also vertically stepped in such a manner that their contents, as revealed by the lowered top edge of each front panel 5*a* of a compartment 4, remain visible. In the preferred embodiment, this is achieved by using a plurality of mounting means whereby the mounting means used for a back panel 5*b* is also used as the same means for mounting the front panel 5*a* of the following compartment 4. In other words, the set of tracks 12 used as the mounting means for the back panel 5*b* of a compartment 4 is the same set of tracks 12 used as the mounting means for the front panel 5*a* of the next compartment 4.

In a preferred embodiment of the filing assembly of the present invention, compartments numbered 1 through n (compartment 1 being the front or first compartment and compartment n being the back or last compartment) are positioned in the filing support in the following manner. The front panel of hanging compartment 1 is suspended on the lowest mounting means, the back panel of hanging compartment 1 and the front panel of compartment 2 are suspended on the next higher mounting means, the back panel of compartment 2 and the front panel of compartment 3 are suspended on still the next higher mounting means, and so forth until the back panel of compartment n is mounted on the highest mounting means.

Preferably, in this embodiment, the top edge of each of the back panels of hanging compartments 1 through compartment n−1 is common with the top edge of each of the front panels of hanging compartments 2 through n, respectively. In this case, the suspension means used to support the back panel of one compartment can also be shared by the front panel of the neighboring compartment. For example, a transverse metal rod ending in hooks 11 which may be used as the suspension means for a back panel may be used as the same suspension means for the front panel of the following compartment 4.

One-piece insert 20 comprises a series of panels joined together in a manner whereby the top edge of the back panel of a compartment is attached to the top edge of the front panel of the compartment directly behind, and shares the same hanging (suspension) and mounting means. The one-piece insert should preferably have alternating short and long panels. That is, the initial panel of the insert should preferably be shorter in height (top edge where hanging means is affixed to bottom) than the second panel in the insert, the third panel should be about equal in height to the first panel, the fourth panel should be about equal in height to the second panel, and so forth, ending with the last panel being equal in height to the second panel. The integral insert so formed may be inserted into the filing support by positioning the first hanging means into the lowest mounting means, the second into the next higher, and so forth until the last hanging means is positioned in the uppermost used mounting means. The insert may be removed from the filing support.

Figure 2:
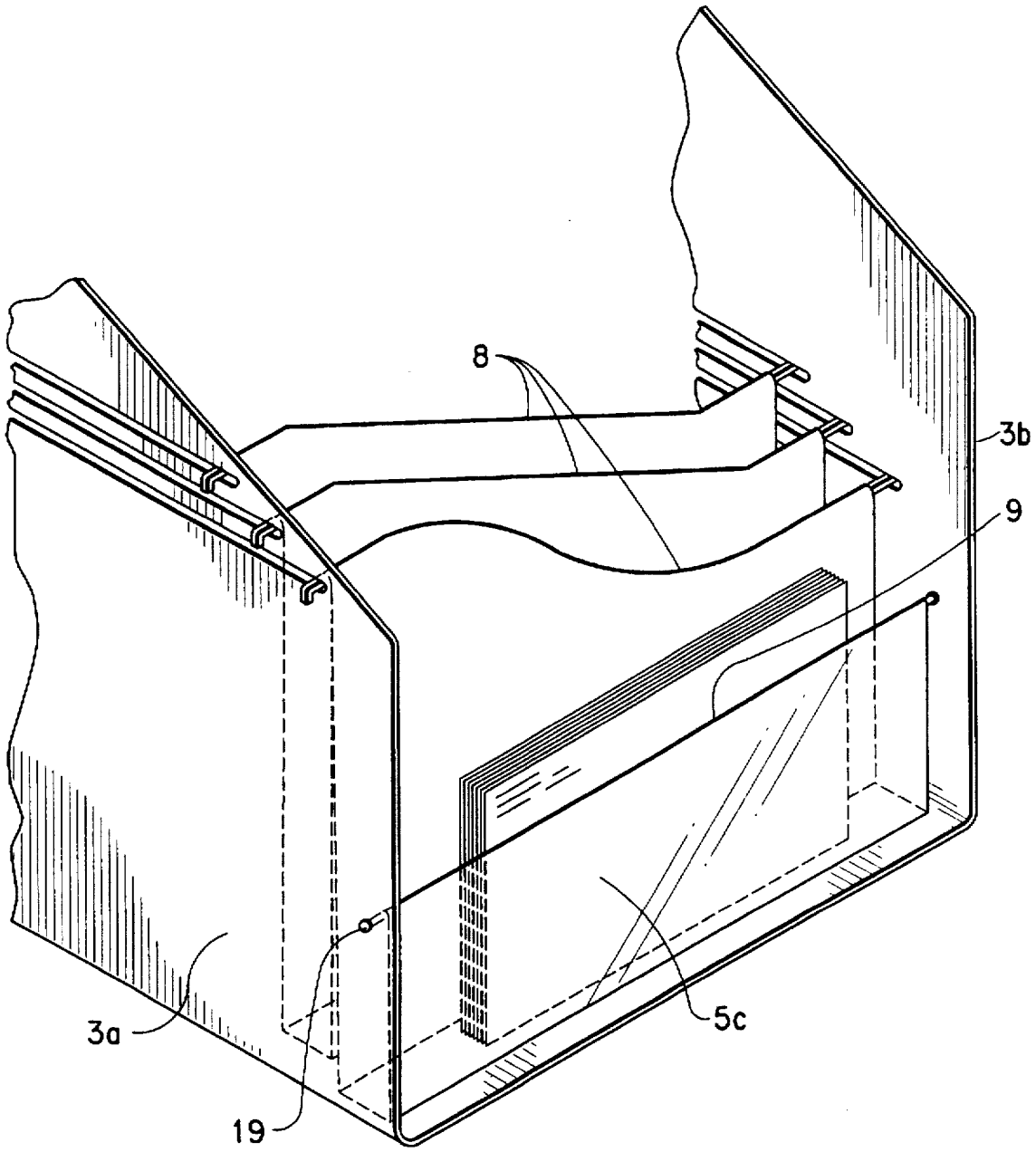
FIG. 2 is a partial perspective view of the file assembly with an alternative compartment design than that illustrated in FIG. 1 with a partial phantom of two compartments.

With such a one-piece insert 20 as heretofore described, forces exerted on the system will dissipate throughout the attached compartments causing a dynamic adjustment as their nominal positions shift relative to one another along their tracks 12 when contents are placed in or removed from a compartment. While this is desired, it may be preferable in one embodiment to limit the dynamic adjustment of the system by affixedly mounting both the first front panel 5*a* and the last back panel 5*b* of the insert to help dampen any extreme forces which may push all the compartments to the back of the filing support. FIG. 2 shows a front panel 5*c* affixedly mounted in hole 19 such that its suspension means is rotatably engaged rather than slidably engaged. This allows the panel 5*c* to react to any dynamic adjustment without moving from its affixed position at the front of the filing support.

In another embodiment for certain types of contents, it may be preferable to severely reduce the dynamic adjustment of all the compartments. Tracks 12 may be shortened to restrict the range of motion of all the panels 5*a* and 5*b* of the insert 20 as needed, even to the point whereby all the panels 5*a* and 5*b* become rotatably affixed instead of slidably engaged, being mounted in a manner similar to that shown for panel 5*c* at hole 19 in FIG. 2. With this configuration, contents that can be stored in a compartment of fixed size, such as brochures, catalogs, or tablets of different types of blank forms, may then be stored upright without an added aggravation of having the panels slide. The dynamic adjustment of such an embodiment is then limited to the static compliance ("give") in the flexible material of panels 5*a* and 5*b* and the free motion available in the rotation of the suspension means of panels 5*a* and 5*b*.

As they ascend, the starting point of each mounting means is preferably stepped one behind the other, horizontally spaced back a distance about equal to the length of the floor member of a compartment in such a manner that each compartment remains open a set amount when positioned all the way forward. The ending point of each set of mounting means has not been so stepped in order to minimize the footprint of the assembly. That is to say, that the line formed by connecting the starts of each set of mounting means (at the front of the assembly) is preferably sloped, while the line formed by connecting the ends of each set (at the back of the assembly) is vertical.

It should also be noted that the top edges of panels 5*a* and 5*b* need not be substantially horizontal, nor even straight. As shown in FIG. 2, a curved or slanting top edge 8 of a panel 5*a* or 5*b* may be provided to allow for better access to the contents therein. Even the top edge 9 of the first front panel 5*c* as also shown in FIG. 2 may be substantially lowered to accommodate smaller material such as envelopes, index cards, and the like. For this type of insert, the mounting means may be altered to accommodate. As can be seen from FIG. 2, the slots in side wall 3*a* from which any top edge 8 is suspended are positioned vertically higher than the corresponding slot in opposing side wall 3*b*. It should be clear, however, that a filing support having corresponding slots in the side walls at the same vertical height can be used to support a slanted top folder. The lower-positioned hanging means would merely be suspended from one of the lower slots.

As will be appreciated by one skilled in the art, the filing support of the present invention may be configured to accept the insertion of compartments in the form of an insert 20 provided separately. Further, the filing support of the present invention can be used for independent hanging compartments wherein each compartment is formed individually and suspended from the mounting means. The insert 20, whether integral to the assembly or separately provided, as well as independent hanging compartments may be made of materials typically used to make file folders. These independent hanging compartments preferably take the form of a modified hanging folder.

The modified hanging folder of this invention comprises a front panel and a back panel joined along their bottom edges (preferably with an essentially flat, substantially rigid floor member) and a hanging means (preferably hooks at the terminal ends of metal bars extending across the top edges of the front and back panels), the front panel being shorter in height (top edge to bottom edge) than the back panel. The difference in height should be about that of the vertical spacing of the mounting means in a corresponding filing support so that, in the preferred assembly configuration, the floor member is substantially parallel to the surface on which the assembly is placed. A standard Pendaflex® folder may be made into such a modified folder by creasing along a bottom score located across its front panel to form a floor member while dropping the top edge of its front panel at the same time. The hooks on the top edge of this front panel of the modified Pendaflex® folder may then be placed on a track below the one on which the hooks on the top edge of the back panel are placed. As such, the support assembly can be configured to accept Pendaflex® folders comprising the compartments 4.

With individual compartments, more flexibility can be achieved. For example, standard Pendaflex® folders may be used along with the modified hanging folders of the present invention. In such a configuration, a modified folder would be inserted with the hanging means of the front panel positioned in the lowest mounting means of the filing support and the hanging means of its back panel in the next higher (second) mounting means. One or more standard Pendaflex® folders could then be positioned on the second mounting means. The assembly could continue with the next modified folder suspended from the second and third (next higher) mounting means with one or more Pendaflex® folders positioned on the third mounting means and so forth, resulting in a configuration customized to individual desire.

Many modifications may be made without departing from the spirit of the invention described above as a preferred embodiment. Different color striping may be added across the top edges of the panels 5*a* and 5*b* to help visualize the frame of reference. Feet 17, useful to protect desk surfaces, are shown in FIG. 1. Pendaflex® plastic labels may be placed in slits 18 shown for the first compartment 4 in FIG. 1. A lid may be added with locking mechanism to provide for security of the contents. The side walls can be extended to provide a space under the insert bottom. Desk accessories such as a pencil holder, a notepad holder or the like may attached to the filing support. Further uses and/or adaptations of the invention, including various changes in the details of the illustrated construction, and such departures from the present disclosure as come within known or customary practice in the art to which the invention pertains, fall within the scope of the appended claims.

Claimed herein is:

1. A vertical filing assembly comprising a filing support having more than two mounting means vertically spaced from each other, each mounting means being tracks spaced apart from and substantially parallel to each other, and two or more file compartments, each file compartment having a front panel having a top edge and a bottom edge and a back panel having a top edge and a bottom edge adjoining the bottom edge of the front panel, wherein the compartments are contained in the filing support and wherein the back panel and the front panel of each compartment has a suspension means, at least one of the suspension means for each compartment being slidably engaged with the mounting means in a manner that a. the top edge of the front panel of each compartment is positioned lower than the top edge of the back panel of that compartment and is positioned at least as high the top edge of the back panel of the compartment immediately in front of it in the filing assembly, and b. each compartment can be opened by sliding the front panel or the back panel on the mounting means from which it is suspended or by sliding both front and back panels on the mounting means from which they are suspended.

2. The filing assembly of claim 1 wherein the front panel of each compartment is suspended from a first mounting means and the back panel of each compartment is suspended from a second mounting means, the first mounting means for each compartment being lower than the second mounting means for that compartment.

3. The filing assembly of claim 2 wherein the front panel of each compartment is suspended from the same mounting means as the back panel of the compartment immediately in front of it in the filing assembly.

4. The filing assembly of claim 2 having at least a first compartment and a last compartment, wherein a. the suspension means of the front panel of the first compartment is suspended from a first mounting means, the first mounting means being below all other mounting means from which compartments are suspended, b. the suspension means of the back panel of the last compartment is suspended from a last mounting means, the last mounting means being above all other mounting means from which compartments are suspended, c. the top edge of the back panel of the first compartment is common with the top edge of and shares the suspension means of the front panel of the compartment directly behind it in the filing assembly, and d. the top edge of the back panel of any compartment intermediate between the first and the last compartment is common with the top edge of the front panel of and shares the suspension means of the compartment directly behind that compartment in the filing assembly.

5. The filing assembly of claim 2 wherein the compartments comprise modified folders each comprising a front panel having a top terminal end and a bottom edge, a back panel having a top terminal end and a bottom edge adjoining the bottom edge of the front panel, each front panel and each back panel of each compartment having a suspension means, the front panel being shorter in height measured from the top edge to bottom edge than the back panel wherein the difference in height of the back panel and the front panel of the modified folder is about the same as the vertical spacing of the mounting means.

6. The filing assembly of claim 5 wherein one or more standard hanging folders having panels of like size each having a front panel suspended from the same mounting means as its back panel are interspersed with the modified folders each having a front panel suspended from one mounting means and a back panel suspended from a higher mounting means.

7. A filing support for hanging compartments having vertical side walls having bottom edges the side walls spaced from each other sufficiently to contain file compartments, each compartment having a front panel with a top edge and a back panel with a top edge, the side walls having sufficient integrity to maintain a plurality of overlapping mounting means vertically spaced from each other and positioned sufficiently above the bottom edges of the side walls to allow containment of more than two file compartments when the top edge of the front panel of each compartment is positioned lower than the top edge of the back panel of that compartment and is positioned at least as high as the top edge of the back panel of the compartment immediately in front of it when positioned in the filling support, each mounting means being track spaced apart from and substantially parallel to each other, the track selected from the group consisting of lower edges defined by long, thin openings through each side wall, and bars or rods support from each side wall, each track forming a means from which the more than two file compartments can be slidably suspended.

8. The filing support of claim 7 wherein the tracks are formed from the lower edges defined by long, thin openings in each of two side walls.

9. The filing support of claim 8 wherein for each long, thin opening in one side wall having a lower edge, there is a corresponding long thin opening in the opposing side wall also having a lower edge at about the same relative position with respect to the bottom edge of that side wall as the lower edge of the long, thin opening in the other side wall is to the other side wall's bottom edge.

10. A removable insert adapted for use with the filing support of claim 7, the insert comprising a a first compartment, a last compartment and at least one compartment intermediate to the first and last compartments, each compartment having a front panel having a top edge and a bottom edge and a back panel having a top edge and a bottom edge adjoining the bottom edge of the front panel, wherein the back panel and the front panel of each compartment has a suspension means, the top edge of the back panel of the first compartment being common with the top edge of and sharing the suspension means of the front panel of the compartment directly behind it in the filing assembly, and the top edge of the back panel of any compartment intermediate between the first and the last compartment being common with the top edge of the front panel of and sharing the suspension means of the compartment directly behind that compartment in the insert.

* * * * *